US006953382B1

(12) United States Patent
Korovin et al.

(10) Patent No.: US 6,953,382 B1
(45) Date of Patent: Oct. 11, 2005

(54) METHODS AND APPARATUSES FOR CONDITIONING POLISHING SURFACES UTILIZED DURING CMP PROCESSING

(75) Inventors: Nikolay Korovin, Phoenix, AZ (US); Robert J. Stoya, Cave Creek, AZ (US)

(73) Assignee: Novellus Systems, Inc., San Jose, CA (US)

( * ) Notice: Subject to any disclaimer, the term of this patent is extended or adjusted under 35 U.S.C. 154(b) by 24 days.

(21) Appl. No.: 10/876,826

(22) Filed: Jun. 24, 2004

(51) Int. Cl.[7] ..... B24B 1/00

(52) U.S. Cl. ..... 451/5; 451/9; 451/11; 451/56; 451/443

(58) Field of Search ..... 451/5, 9, 10, 11, 451/56, 443

(56) References Cited

U.S. PATENT DOCUMENTS

| | | | | |
|---|---|---|---|---|
| 5,743,784 | A | 4/1998 | Birang et al. | |
| 5,833,519 | A | 11/1998 | Moore | |
| 6,036,583 | A * | 3/2000 | Perlov et al. | 451/56 |
| 6,231,425 | B1 * | 5/2001 | Inaba et al. | 451/5 |
| 6,306,008 | B1 | 10/2001 | Moore | |
| 6,517,414 | B1 | 2/2003 | Tobin et al. | |
| 6,666,754 | B1 | 12/2003 | Beckage | |
| 6,722,948 | B1 * | 4/2004 | Berman | 451/21 |

FOREIGN PATENT DOCUMENTS

| | | | |
|---|---|---|---|
| JP | 11-42555 | * | 2/1999 |
| JP | 2000-61812 | * | 2/2000 |

* cited by examiner

*Primary Examiner*—Eileen P. Morgan
(74) *Attorney, Agent, or Firm*—Ingrassia Fisher & Lorenz PC

(57) ABSTRACT

Methods and apparatus are provided for conditioning of polishing surfaces utilized during CMP processing. The method comprises contacting the polishing surface and a conditioning surface with a first force, one of the surfaces coupled to a support member that has an axis. The polishing surface and/or the conditioning surface is moved at a constant velocity. Torque exerted by the support member about the axis to effect a relative position between the conditioning surface and the polishing surface is measured and used to obtain a process variable. The process variable is compared to a setpoint value for the relative position of the conditioning surface and the polishing surface. A second force is calculated and the polishing surface and the conditioning surface then are contacted with the second force, if the process variable differs from the setpoint value by more than an allowed tolerance.

49 Claims, 6 Drawing Sheets

METHODS AND APPARATUSES FOR CONDITIONING POLISHING SURFACES UTILIZED DURING CMP PROCESSING

FIELD OF THE INVENTION

The present invention generally relates to chemical mechanical planarization and chemical mechanical polishing, and more particularly relates to the conditioning of polishing surfaces utilized during chemical mechanical polishing processes and chemical mechanical planarizing processes.

BACKGROUND OF THE INVENTION

Chemical mechanical polishing, also known as chemical mechanical planarization (referred to herein collectively as "CMP"), is a technique that has been conventionally used for the planarization of semiconductor wafers. CMP also is often used in the formation of microelectronic devices to provide a substantially smooth, planar surface suitable for subsequent fabrication processes such as photoresist coating and pattern definition. A typical CMP apparatus suitable for planarizing a semiconductor surface generally includes a wafer carrier configured to support, guide, and apply pressure to a wafer during the polishing process, a polishing compound such as a slurry to assist in the removal of material from the surface of the wafer, and a polishing surface such as a polishing pad. In addition, the polishing apparatus may include an integrated wafer cleaning system and/or an automated load/unload station to facilitate automatic processing of the wafers.

A wafer surface is generally polished by moving the surface of the wafer to be polished relative to the polishing surface in the presence of the slurry. In particular, the wafer is placed in the carrier such that the surface to be polished is placed in contact with the polishing surface, and the polishing surface and/or the wafer are moved relative to each other while slurry is supplied to the polishing surface. As a wafer is polished, the slurry and abraded materials from the wafer tend to glaze the polishing surface, making the polishing surface slick and reducing the polishing rate and efficiency.

One method of countering the glazing or smoothing of the polishing surface and achieving and maintaining high and stable polishing rates is to condition the polishing surface by removing old slurry particles and abraded particles which develop on the surface. Scraping the polishing surface with a sharp objector or roughening the polishing pad with an abrasive material restores the polishing surface, thus increasing the ability of the polishing surface to absorb slurry and increasing the polishing rate and efficiency of the polishing system.

One type of conventional conditioning apparatus and conditioning method utilizes an abrasive conditioning surface, such as a diamond-pointed disk or block, disposed on an end effector that is urged against the polishing surface as relative movement between the end effector and the polishing surface is effected. However, these conventional conditioning apparatuses and methods have proven undesirable for a variety of reasons. Typically, a conventional conditioning process is conducted for a predetermined period of time, regardless of the state of wear of the conditioning surface. Accordingly, if conditioning is performed with a worn conditioning surface, the efficiency and effectiveness of the conditioning process may be compromised. Further, conventional conditioning processes typically are conducted for a predetermined period of time regardless of the extent of conditioning of the polishing surface. In this regard, the life of the conditioning surface may be shortened by use during unnecessary conditioning of a polishing surface that has already achieved optimum conditioning. Moreover, conventional conditioning processes are not designed to monitor and account for the wearing of the conditioning surface or the extent of conditioning of the polishing surface in-situ, that is, during a conditioning process. Thus, uniform conditioning may not be achieved during a conditioning process or from process to process.

Accordingly, it is desirable to provide conditioning apparatuses that are configured for uniform in-situ conditioning and for uniform conditioning from polishing surface to polishing surface. In addition, it is desirable to provide conditioning methods that provide uniform in-situ conditioning and uniform conditioning from polishing surface to polishing surface. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
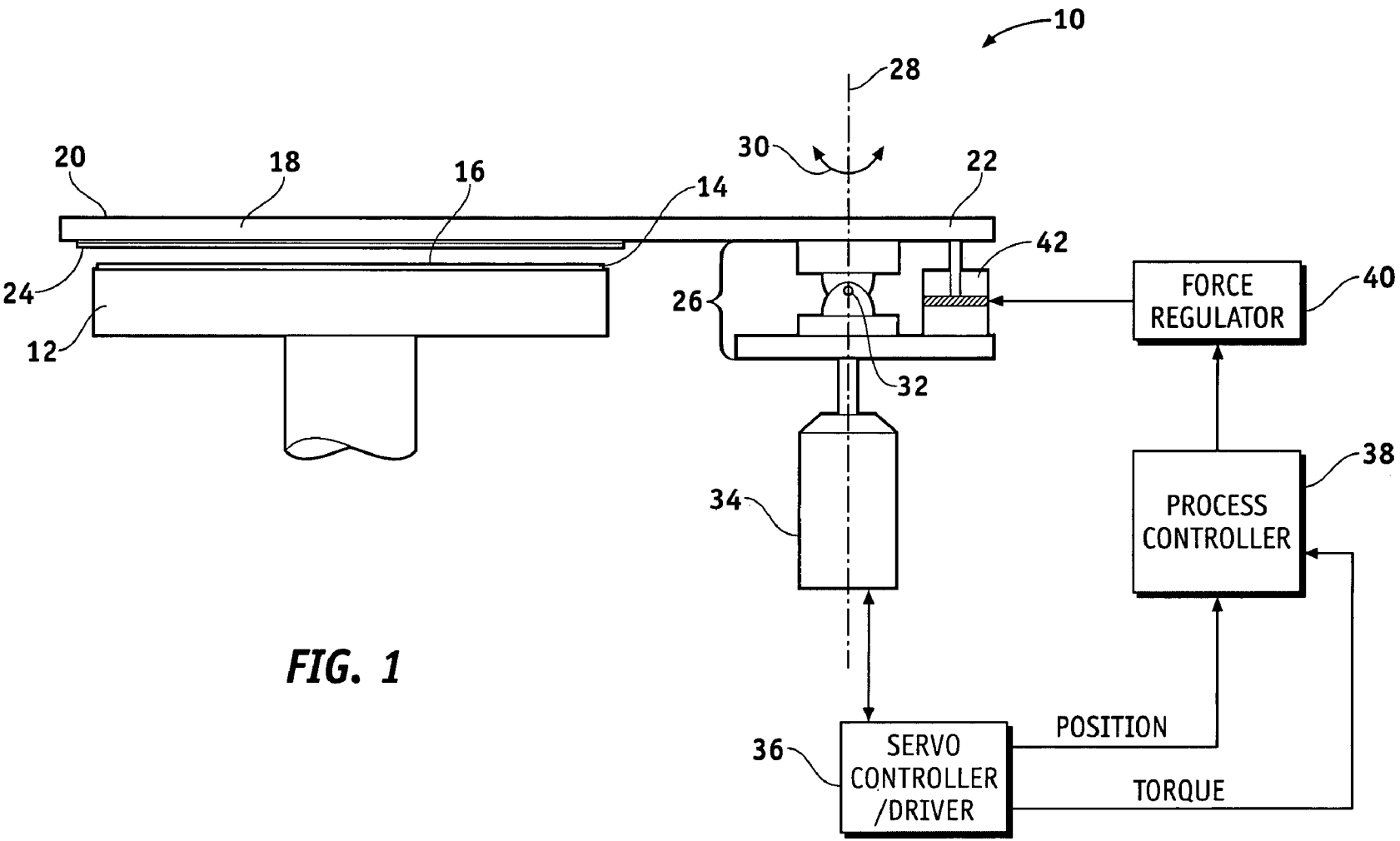
FIG. 1 is a cross-sectional view of an exemplary embodiment of a conditioning apparatus in accordance with the present invention.

Referring to FIG. 1, a conditioning apparatus 10 in accordance with an exemplary embodiment of the present invention comprises a platen 12 upon which may be removably supported a polishing substrate 14 having a polishing surface 16. Polishing substrate 14 may be any suitable polishing medium utilized during CMP processing, such as, for example, a conventional polishing pad made from a continuous phase matrix material, (e.g., polyurethane), a fixed abrasive-type pad made from abrasive particles fixedly dispersed in a suspension medium, or any other suitable polishing substrate. Platen 12 may be coupled to a motor or other motion-inducing device (not shown) that moves platen 12 and polishing substrate 14 in a rotation, orbital or linear motion, or a combination thereof.

Conditioning apparatus 10 further comprises a substantially elongated end effector 18 having a first end 20 and a second end 22. A conditioning surface 24 is disposed at the first end 20 of end effector 18. Conditioning surface 24 may be a conditioning body removably attached to end effector 18 or may be a surface integral with end effector 18. Conditioning surface 24 may be any conditioning medium suitable for conditioning polishing substrate 14. For example, conditioning surface 24 may comprise a layer of diamond grit or other hard abrasive particles imbedded on or in a support medium or may comprise teeth or other mechanical devices that scrape, comb or otherwise condition polishing surface 16 of polishing substrate 14.

End effector 18 is supported at second end 22 by a support assembly 26. Support assembly 26 may be any mechanism that permits the vertical movement of end effector 18 and that provides for the rotation of end effector 18 about an axis 28 of support assembly 26, as illustrated by arrows 30. For example, support assembly 26 may have a piston-type configuration wherein second end 22 of end effector 18 is attached to a piston rod that is configured for vertical sliding motion relative to a cylinder, the piston/cylinder assembly also configured for rotational movement about axis 28. Alternatively, support assembly 26 may have a pivot joint configuration that permits end effector 18 to pivot about an axis 32 and that also rotates about axis 28. It will be appreciated, however, that support assembly 26 may comprise any other suitable configuration or utilize any other device, such as a gimbal joint or other conventional joint, that permits the vertical and rotational movement described above. In an alternative embodiment of the invention, support assembly 26 may be configured to permit the vertical movement of end effector 18 while preventing rotational movement of end effector 18 about axis 28 during a cleaning process.

Support assembly 26 is coupled to an end effector motor 34. End effector motor 34 may comprise any suitable motor mechanism that effects the rotational movement of end effector 18 about axis 28. End effector motor 34 in turn is coupled to a servo controller/driver 36. As described in more detail below, servo controller/driver 36 is configured to monitor the position of end effector 18 relative to polishing substrate 14 and also is configured to measure the torque required by end effector motor 34 to move end effector 18 across polishing substrate 14 during a conditioning process. Servo controller/driver 36 also provides a closed loop control system with end effector motor 34 to effect substantially uniform linear velocity of end effector 18 relative to polishing substrate 14. Servo controller/driver 36 may comprise any suitable conventional servo controller/driver such as, for example, torque servo controller/drivers manufactured by the Compumotor Division of Parker Hannifin Corporation of Rohnert Park, Calif., torque servo motor/controllers manufactured by Kollmorgen Corporation of Lakewood, Colo., and motion controllers manufactured by Galil Motion Control, Inc. of Rocklin, Calif. In a preferred embodiment of the invention, servo controller/driver 36 is a digital controller/amplifier.

Servo controller/driver 36 is in electrical communication with a process controller 38. As described in more detail below, process controller 38 may be any type of microprocessor, micro-controller, or other computing device capable of executing instructions in any computing language. Process controller 38 is in electrical communication with a force regulator 40, which is coupled to an air cylinder 42. Air cylinder 42 in turn is coupled to second end 22 of end effector 18. Force regulator 40 is configured to regulate the force with which end effector 18 contacts polishing substrate 14 by controlling air cylinder 42.

Figure 2:
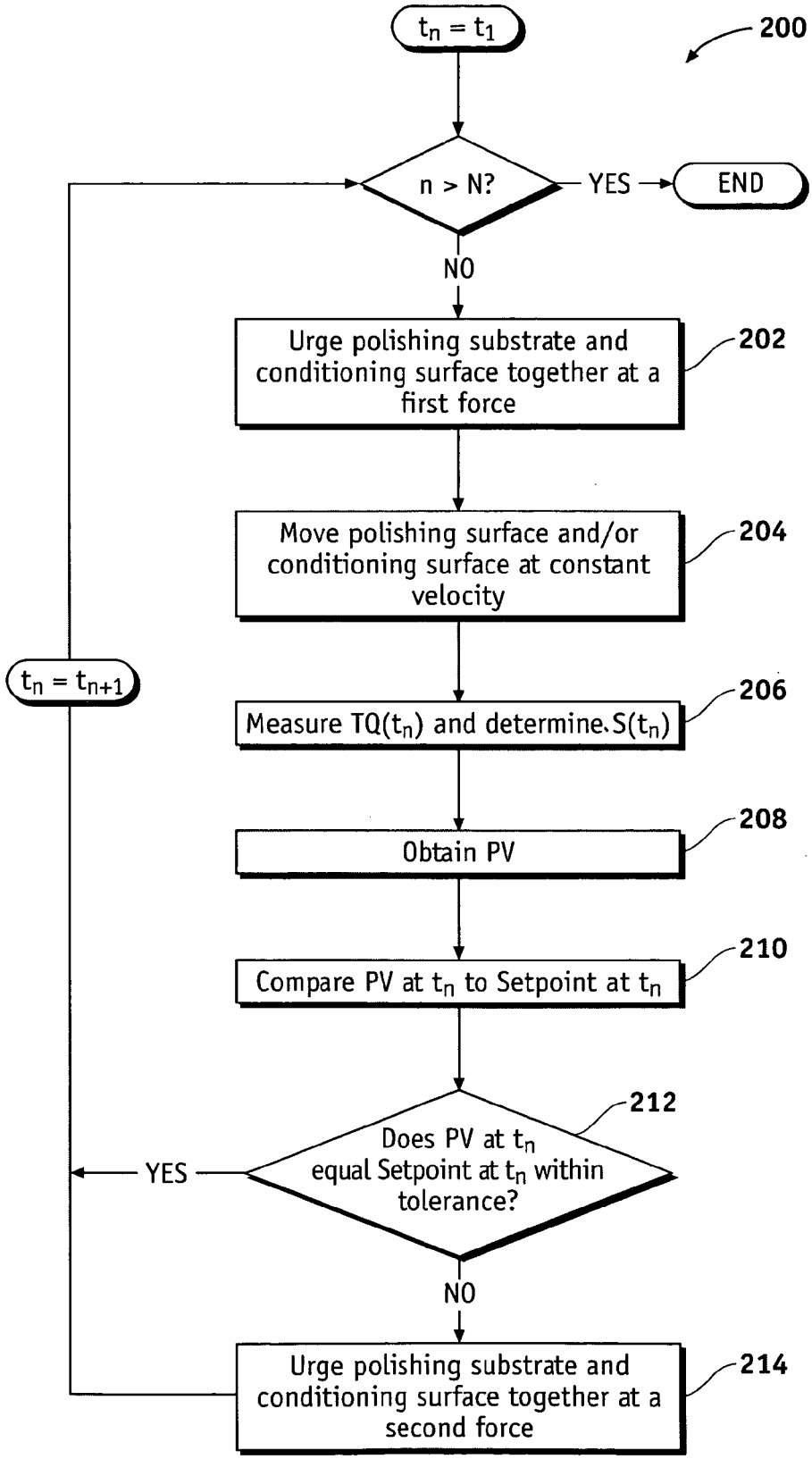
FIG. 2 is a flow chart of an exemplary embodiment of a method for conditioning a polishing substrate in accordance with the present invention.
Figure 3:
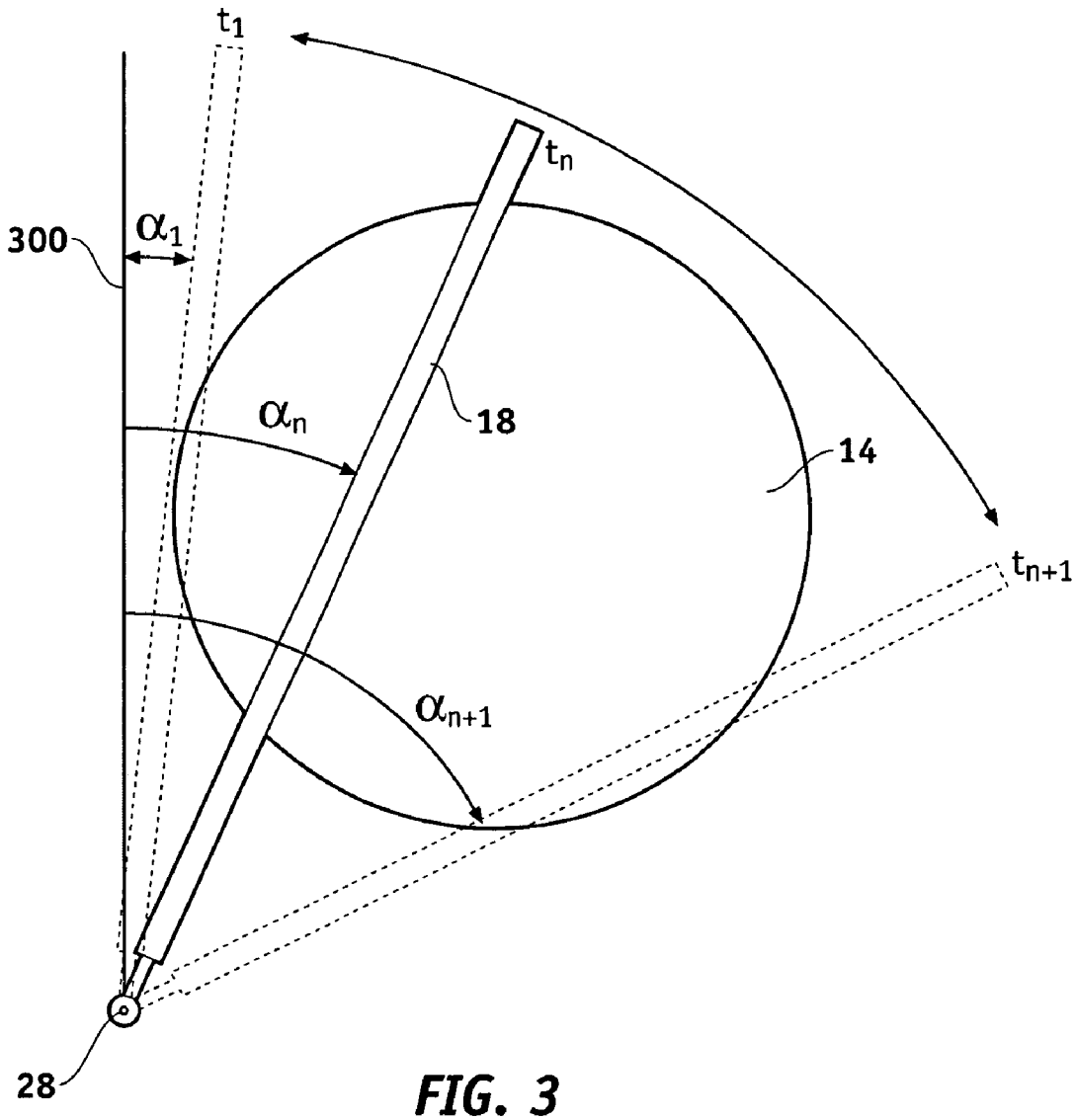
FIG. 3 is a top view of an end effector of the conditioning apparatus of FIG. 1 as it moves across a polishing substrate.

FIG. 2 is a flowchart of a process 200 for conditioning polishing substrate 14 utilizing conditioning apparatus 10. At commencement of a conditioning cycle, that is, at a time $t_1$, support assembly 26 and end effector motor 34 cause conditioning surface 24 of end effector 18 to contact polishing substrate 14 at a first, initial down force (step 202). In one exemplary embodiment of the invention, support assembly 26 may cause conditioning surface 24 of end effector 18 to contact polishing substrate 14 anywhere on polishing surface 16. In a preferred embodiment of the invention, referring to FIGS. 2 and 3, support assembly 26 causes conditioning surface 24 of end effector 18 to contact polishing substrate 14 at an edge of polishing substrate 14 at an angle $\alpha_1$ measured from a reference axis 300. End effector motor 34 then causes end effector 18 to rotate about axis 28 and sweep across the polishing surface 16 of polishing substrate 14 at a constant linear velocity relative to polishing substrate 14 (step 204). End effector 18 may make one sweep across the polishing surface 16 of polishing substrate 14 or may make multiple sweeps across or back and forth across the polishing surface. While end effector 18 is swept across polishing substrate 14, polishing substrate 14 may remain stationary or, in another embodiment of the invention, polishing substrate 14 may be caused to move in a rotational, orbital, or linear motion, or a combination thereof. In an alternative embodiment of the invention, end effector 18 may remain stationary while polishing substrate 14 is caused to move in a rotational, orbital, or linear motion, or a combination thereof.

As motion is effected between end effector 18 and polishing surface 16, such as by moving end effector 18 across polishing surface 16, servo controller/driver 36 measures a torque $TQ(t_n)$, described in more detail below, and the position of the end effector relative to polishing substrate 14 at each time $t_n$ during the sweep or sweeps of end effector 18, where n ranges from 1 to N, N is a whole integer representing the total number of time increments monitored during the conditioning process, and $t_1$ is the commencement of the conditioning process. Measurements of the torque and position of end effector 18 can be taken during any suitable time intervals, such as, for example, every second, every tenth of a second, every hundredth of a second, and the like. In a preferred embodiment of the invention, torque and position measurements are taken by servo controller/driver 36 at every millisecond. From the position of end effector 18, the contact area $S(t_n)$ between conditioning surface 24 and polishing surface 16 can be determined, as described in more detail below.

The conditioning effect (CE) of conditioning surface 24 of end effector 18 on polishing surface 16 is affected by the pressure exerted by end effector 18 against the polishing surface 16, the linear velocity of the end effector 18 across the polishing surface 16, and the number of sweeps of the end effector 18 over the polishing surface 16 and/or the conditioning time. Accordingly, the conditioning effect (CE) may be described according to the following equation:

$$CE(x, y) = \int_{t1}^{tn} k(x, y, t) \times V(x, y, t) \times P(x, y, t)\, dt \quad (1)$$

where x and y indicate the coordinates of a point on the polishing surface 16, $t_1$ is the beginning of the conditioning process, $t_N$ is the end of the conditioning process, V is the relative linear velocity of the end effector 18, P is the pressure applied by the end effector 18 to polishing surface 16, and k is a coefficient that takes into account factors such as interactions between the end effector 18 and the polishing surface 16, the coefficient of friction, temperature distribution, chemical activity, and the like. Of these factors that influence the value of k during the conditioning process, the coefficient of friction ($\mu$) dominates. Thus, k may be represented by the equation:

$$k(x, y, t)=\mu(x, y, t)\times\alpha, \quad (2)$$

where $\alpha$ is a coefficient of proportionality that represents properties of polishing substrate 14.

It is desirable to optimize in-situ the uniformity of the conditioning process, that is, it is desirable to optimize the uniformity of the conditioning process during the conditioning process, and it is further desirable to optimize the uniformity of the conditioning process from polishing substrate to polishing substrate. Accordingly, it is desirable to achieve the following conditions:

$$\int_{t1}^{tn} V(x, y, t)\, dt = const, \text{ and} \quad (3)$$

$$\mu(x, y, t)\times P(x, y, t)=\text{const} \quad (4)$$

As condition (3) does not depend on the state of consumables, and thus does not contribute to process instability, uniform velocity can be acquired with the mechanical design of conditioning apparatus 10, such as by the use of servo controller/driver 36.

The term $\mu(x,y,t)\times P(x,y,t)$ of condition (4) may be defined as the shear force per unit area between conditioning surface 24 and polishing surface 16 during conditioning. Assuming constant velocity of end effector 18, the conditioning effect (CE) will remain constant if the shear force between conditioning surface 24 and polishing surface 16 remains constant. The shear force between conditioning surface 24 and polishing surface 16 depends on various factors, including the state of wear of conditioning surface 24, conditions of friction between conditioning surface 24 and polishing surface 16. and the pressure applied by end effector 18 to polishing surface 16. Shear force cannot be measured directly. However, if the contact area between end effector 18 and polishing surface 16 is known, then:

$$\iint \mu(x, y, t)\times P(x, y, t)\, dxdy=TQ(t_n), \quad (5)$$

where $TQ(t_n)$ is a torque required by end effector motor 34 to overcome the friction between end effector 18 and polishing surface 16 at a time $t_n$ to move end effector 18 about axis 28 relative to polishing surface 16. Equation (5) may be presented in terms of average values:

$$\bar{\mu}(t_n) \times \bar{P}(t_n) = \frac{TQ(t_n)}{S(t_n)} \quad (6)$$

where $S(t_n)$ is the contact area between end effector 18 and polishing surface 16 at time $t_n$.

As the shear force is directly related to the force the end effector applies to the polishing surface 16, from the calculation of $TQ(t_n)/S(t_n)$, conditioning apparatus 10 may determine the appropriate force by which end effector 18 may contact polishing surface 16 to maintain a constant shear force.

Figure 4:
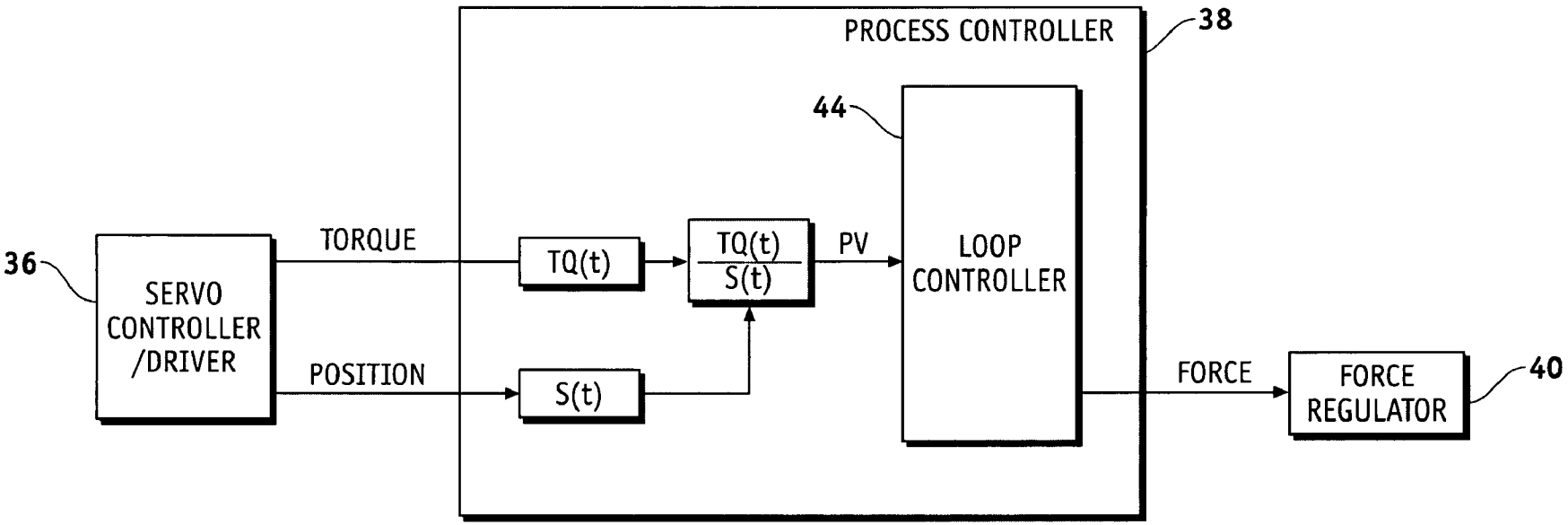
FIG. 4 is a schematic representation of a process controller of the conditioning apparatus of FIG. 1.

With reference now to FIGS. 2 and 4, once servo controller/driver 36 has measured $TQ(t_n)$ and determined the position of the end effector at time $t_n$ (and, hence, at an angle $\alpha_n$), process controller 38 may determine the contact area $S(t_n)$ and, from $TQ(t_n)$ and $S(t_n)$, may calculate a process variable (PV) (step 208). In one embodiment, PV may equal $TQ(t_n)/S(t_n)$. In another embodiment of the invention, PV may equal any other suitable value calculated from $TQ(t_n)$ and $S(t_n)$. Once PV is calculated by process controller 38, process controller 38, via a loop controller 42 or any other suitable computing device, may compare PV to a Setpoint value stored within loop controller 42 (step 210). The Setpoint value may be obtained experimentally by process performance data acquired during operation of an open-loop conditioning process(es) and may represent the desired and/or expected value of PV at time $t_n$. The Setpoint value may be dependent on the time interval $t_n$ during which $TQ(t_n)$ and $S(t_n)$ are calculated, that is, the Setpoint value may vary with time, or, alternatively, the Setpoint value may be the same value for all times $t_n$.

Process controller 38 operates as a multi-input, single-output closed loop control system (CLC) with the servo controller/driver 36 acting as a feedback element. The process controller 38 provides control output signals to the force regulator 40 so that the force of the end effector 18 against the polishing substrate 14 may be modulated to uniformly maintain the shear force per unit area. The control algorithm employed by the process controller should provide at least a proportional-integral (PI) capability; however, a proportional-integral-derivative (PID) algorithm is preferred. The process controller 38 may be a programmable digital computer with stored instructions to execute the control algorithm, with analog to digital (A/D) and/or digital to analog (D/A) interfaces to communicate with the servo controller/driver 36 and the force regulator 40, or it may be a self-contained programmable logic controller (PLC). In one embodiment of the invention, the process controller 38 is a device separate from the servo controller/driver 36. In another, preferred, embodiment of the invention, process controller 38 is integral with servo controller/driver 36 to minimize the size and complexity of conditioning apparatus 10.

If the Setpoint value and PV differ by more than a predetermined allowed tolerance, process controller 38 may calculate a new force by which the end effector 18 may contact polishing substrate 14 to maintain a uniform shear force throughout the conditioning process. The new force may be calculated using the following equations:

$$E(t_n)=\text{Setpoint}(t_n)-PV(t_n) \quad (7)$$

$$\text{Force}(t_n) = K_P \times E(t_n) + K_I \times \int_{t_1}^{t_N} E(t_n)\,dt + K_D \times \frac{dE(t_n)}{dt} \quad (8)$$

where $K_P$, $K_I$, $K_D$ are the Proportional, Integral, and Derivative coefficients respectively. Thus, the calculated new force will depend on the real-time error $E(t_n)$, history of the error (i.e, the accumulated error), and the rate of change of the error. A signal representing the value of the new force may be transmitted to force regulator 40, which in turn may modify the pressure within air cylinder 42 so that end effector 18 is urged against polishing substrate 14 with the new calculated force (step 214).

The above-described conditioning process may continue through all time intervals $t_1$, through $t_N$, as illustrated in FIG. 2. Alternatively, conditioning apparatus 10 may be configured so that when the calculated PV value does not differ from the Setpoint value by more than an allowed tolerance for a set of predetermined time intervals (e.g., those time intervals where angle $\alpha$ is 30 degrees, 45 degrees, and 60 degrees) or for a predetermined number of time intervals (e.g., five time intervals in one sweep), the conditioning process may be terminated. In this regard, the life of the conditioning surface 24 of the end effector 18 may be extended beyond that realized if the conditioning process continued for all time intervals $t_1$ through $t_N$ regardless of the conditioned state of the polishing surface 16.

In another embodiment of the present invention, conditioning apparatus 10 may be configured to identify the end of life of the conditioning surface 24 of end effector 18. In other words, conditioning apparatus 10 may be configured to determine when the conditioning surface 24 has dulled to a point that replacement of conditioning surface 24 and/or end effector 18 is desirable or required to facilitate optimization of conditioning. The end of life of conditioning surface 24 may be determined from the force calculated by process controller 38 during a conditioning process. If the force calculated by process controller 38 is equal to or greater than a predetermined maximum force at a time $t_n$, or is equal to or greater than a predetermined maximum force for a given set of time intervals (e.g., those time intervals where angle $\alpha$ is 30 degrees, 45 degrees, and 60 degrees) or for a given number of time intervals (e.g., five time intervals in one sweep), the process controller may generate an alarm event, such as an audio or visual signal, indicating that the conditioning surface 24 and/or end effector 18 should be replaced.

Conditioning apparatus 10 is described above with reference to the calculation of a down force to be applied by end effector 18 against polishing substrate 14. That is, conditioning apparatus 10 is described with end effector 18 disposed above polishing substrate 14 and with the force calculated by process controller 38 to be applied by end effector 18 downwardly against polishing substrate 14. However, it will be appreciated that the present invention is not limited to this orientation. In another embodiment of the present invention, conditioning apparatus 10 may be configured with end effector 18 disposed substantially below polishing substrate 14 and with the force calculated by process controller 38 to be applied by end effector 18 upwardly against polishing substrate 14. In a further embodiment of the present invention, conditioning apparatus 10 may be configured with end effector 18 disposed substantially above or substantially below polishing substrate 14 and with support assembly 26 and air cylinder 42 coupled to platen 12. In this regard, process controller 38 may be configured to calculate the force that platen 12 may apply against conditioning surface 24 of end effector 18.

The conditioning apparatuses of the present invention also are not limited to the use of servo controller/drivers to measure the torque of end effector 18 about axis 28. Rather, in alternative embodiments of the invention, sensors, such as strain gauges, torque sensors, deflection sensors and the like may be suitably coupled to support assembly 26 and/or end effector 18 to measure $TQ(t_n)$. The measured torque value may then be sent from the sensor(s) to process controller 38 for further processing.

Figure 5:
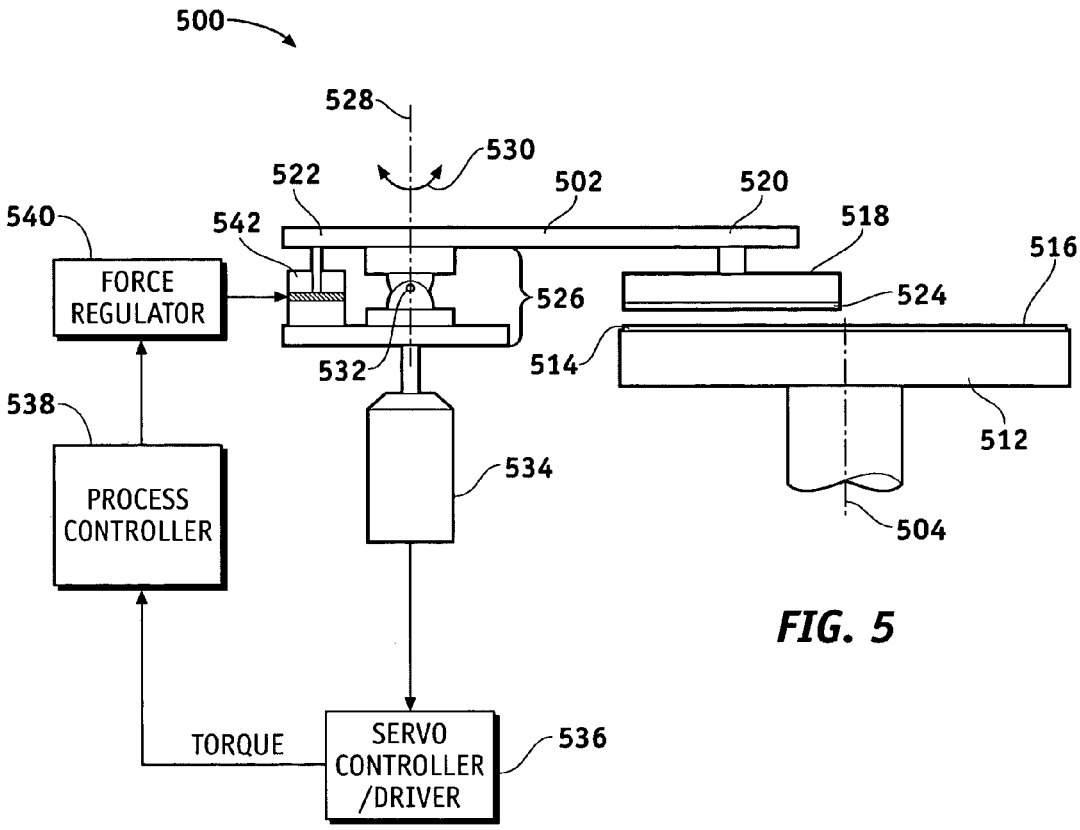
FIG. 5 is a cross-sectional view of another exemplary embodiment of a conditioning apparatus in accordance with the present invention.
Figure 6:
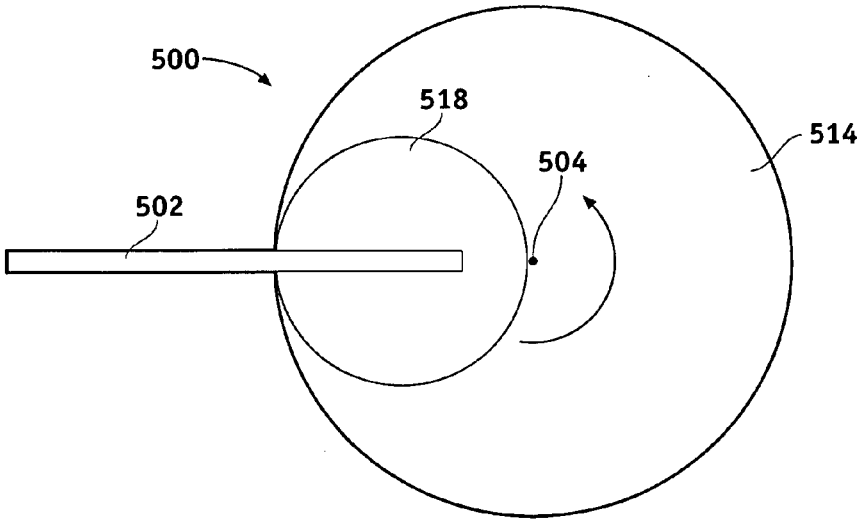
FIG. 6 is a top view of an end effector of the conditioning apparatus of FIG. 5 as a polishing substrate moves relative thereto.

It also will be understood that the conditioning apparatuses of the present invention are not limited to use of elongated end effectors, such as end effector 18, but may use a variety of suitable end effectors for conditioning a polishing substrate. FIGS. 5 and 6 illustrate a conditioning apparatus 500 in accordance with another exemplary embodiment of the present invention. Conditioning apparatus 500 comprises a platen 512 upon which may be removably supported a polishing substrate 514 having a polishing surface 516. Polishing substrate 514 may be any suitable polishing medium as described above with reference to polishing substrate 14 of FIG. 1. Platen 512 is coupled to a motor or other motion-inducing device that causes polishing substrate 514 to rotate about a center axis 504 at a uniform velocity. Platen 512 also may be configured to move in an orbital or linear motion, or a combination of rotational, orbital and/or linear motion.

Conditioning apparatus 500 further comprises a disk-shaped end effector 518. A conditioning surface 524 is disposed on end effector 518. Conditioning surface 524 may be a conditioning body removably attached to end effector 518 or may be a surface integral with the end effector 518. Conditioning surface 524 may be any conditioning medium suitable for conditioning polishing substrate 514, such as the conditioning surfaces described above for conditioning surface 24 with reference to FIG. 1.

End effector 518 is supported by a first support assembly 502 having a first end 520 and a second end 522. First support assembly 502 is coupled to end effector 518 at first end 520 and may be configured to rotate end effector 518 about a central axis or may be configured to keep end effector 518 stationary during a conditioning process. First support assembly 502 is coupled at its second end 522 to a second support assembly 526. Second support assembly 526 may be any mechanism that permits the vertical movement of first support assembly 502, and hence end effector 518, and that permits the rotation of first support assembly 502 about an axis 528 or, alternatively, maintains end effector 518 stationary during a conditioning process. Movement of first support assembly 502 about axis 528 is illustrated by arrows 530. Second support assembly 526 may have a piston-type configuration wherein second end 522 of first support assembly 502 is coupled to a piston rod that is configured for vertical sliding motion relative to a cylinder, the piston/cylinder configuration also configured for rotational movement about axis 528. Alternatively, second support assembly 526 may have a pivot joint configuration that permits first support assembly 502 to pivot about an axis 532 and that also rotates about axis 528. It will be appreciated, however, that second support assembly 526 may comprise any other suitable configuration or utilize any other device, such as a gimbal joint or other conventional joint, that permits the vertical and rotational movement described above.

Second support assembly 526 is coupled to a motor 534. Motor 534 may comprise any suitable motor mechanism that effects the rotational movement of first support assembly 502 about axis 528. Motor 534 may also be configured to drive a pulley/gear assembly (not shown) that may rotate end effector 518 about its central axis. Motor 534 in turn is coupled to a servo controller/driver 536. As described in more detail below, servo controller/driver 536 is configured to measure the torque required to maintain the stationary position of first support assembly 502 relative to polishing substrate 514 during a conditioning process. Servo controller/driver 536 may comprise any suitable servo controller/driver, such as those described above for servo controller/driver 36 with reference to FIG. 1.

Servo controller/driver 536 is in electrical communication with a process controller 538. Process controller 538 may be any type of microprocessor, micro-controller, or other computing device capable of executing instructions in any computing language. Process controller 538 is in electrical communication with a force regulator 540. Force regulator 540 is coupled to an air cylinder 542, which is in turn coupled to second end 522 of first support assembly 502. Force regulator 540 is configured to regulate the force with which end effector 518 contacts polishing substrate 514 by controlling air cylinder 542. While the above-described embodiment comprises a system whereby end effector 518 contacts polishing substrate 514 with a down force effected by force regulator 540, it will be appreciated that the present invention may comprise a system whereby platen 512 is in electrical communication with force regulator 540 that causes polishing substrate 514 to contact conditioning surface 524 with an upward force effected by force regulator 540. Alternatively, platen 512 and polishing substrate 514 may be disposed above end effector 518 and conditioning apparatus 500 may be configured to cause end effector 518 to contact polishing substrate 514 with an upward force or may be configured to cause polishing substrate 514 to contact end effector 518 with a down force.

During conditioning of polishing substrate 514, at a time $t_1$ second support assembly 526 and motor 534 cause conditioning surface 524 of end effector 518 to contact polishing substrate 514 at an initial force. Before, upon, or after contact with conditioning surface 524, platen 512, and hence polishing substrate 514, may begin to rotate about axis 504.

As polishing substrate 514 rotates, the friction between polishing surface 516 and conditioning surface 524 applies a torque to first support assembly 502 about axis 528. Motor 534 applies an opposite torque, $TQ(t_n)$, to first support assembly 502 about axis 528 to maintain first support assembly 502, and hence end effector 518, in a stationary position. Servo controller/driver 536 measures the torque $TQ(t_n)$ at each time interval $t_n$, where n ranges from 1 to N, and N is the total number of time intervals monitored during the conditioning process.

As described above, the shear force realized between conditioning surface 524 and polishing surface 516 may be presented in terms of average values:

$$\overline{\mu}(t_n)\times\overline{P}(t_n)=\frac{TQ(t_n)}{S(t_n)}. \tag{6}$$

However, because the surface contact area between conditioning surface 524 and polishing surface 516 remains constant throughout the conditioning process, Equation (6) may be written as:

$$\overline{\mu}(t_n)\times\overline{P}(t_n)=TQ(t_n) \tag{7}.$$

As the shear force is directly related to the down force the end effector 518 applies to the polishing surface 516, from $TQ(t_n)$ conditioning apparatus 10 may determine the appropriate down force by which end effector 518 may contact polishing surface 516 to maintain a constant shear force. Accordingly, once servo controller/driver 536 has measured $TQ(t_n)$ at time $t_n$, process controller 538 may calculate a process variable (PV) from $TQ(t_n)$. In one embodiment, PV may equal $TQ(t_n)$. In another embodiment of the invention, PV may equal any other suitable value calculated from $TQ(t_n)$. Once PV is calculated by process controller 538, process controller 538 may compare PV to a Setpoint value stored within a loop controller of process controller 538. The Setpoint value may be obtained experimentally by process performance data and may represent the desired and/or expected value of PV at a time $t_n$. As the position of end effector 518 relative to polishing substrate 514 remains constant from $t_1$ to $t_N$, the Setpoint value may be the same value for all times $t_n$.

Process controller 538 operates as a single-input, single-output closed loop control system (CLC) with the servo controller/driver 536 acting as a feedback element. The process controller 538 provides control output signals to the force regulator 540 so that the force of the end effector 518 against the polishing substrate 514 is modulated to uniformly maintain the shear force. As described above, the control algorithm employed by the process controller should provide at least a proportional-integral (PI) capability; however, a proportional-integral-derivative (PID) algorithm is preferred. Process controller 538 may have the same configuration as that described above for process controller 38 with reference to FIG. 1.

If the Setpoint value and PV differ by more than a predetermined allowed tolerance, process controller 538 may calculate a new force by which the end effector 518 may contact polishing substrate 514 to maintain a uniform shear force throughout the conditioning process. A signal representing the value of the force may be transmitted to force regulator 540, which in turn may modify the pressure within air cylinder 542 so that end effector 518 is urged against polishing substrate 514 with the new calculated force.

Figure 7:
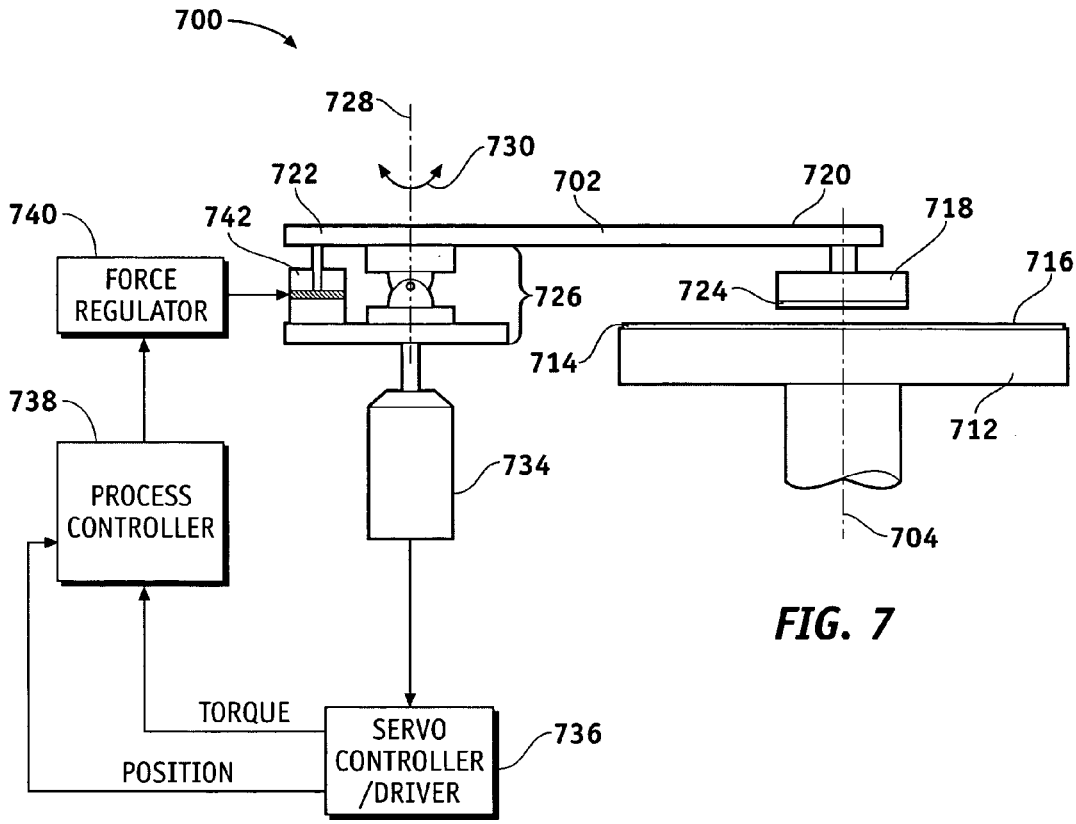
FIG. 7 is a cross-sectional view of a further exemplary embodiment of a conditioning apparatus in accordance with the present invention.
Figure 8:
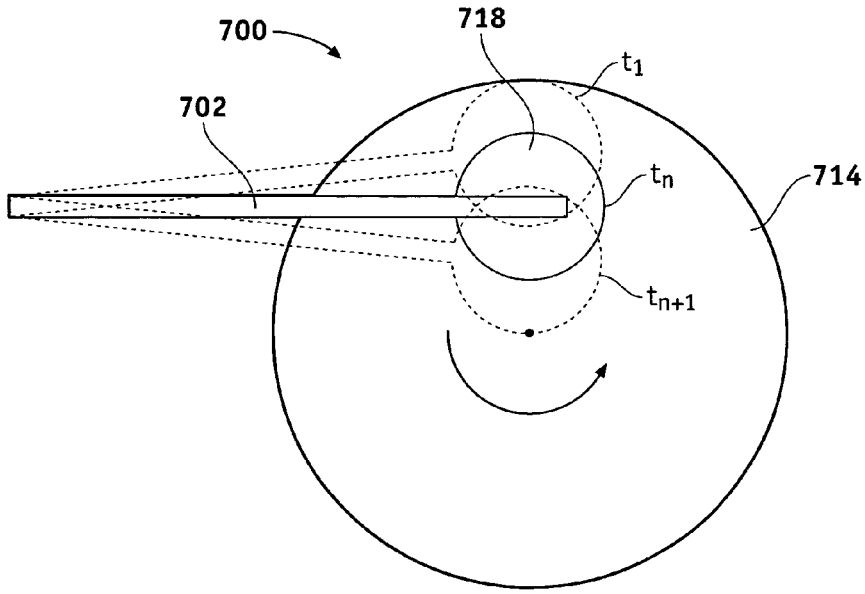
FIG. 8 is a top view of an end effector of the conditioning apparatus of FIG. 7 as it moves across a radius of a polishing substrate.

FIGS. 7 and 8 illustrate a conditioning apparatus 700 in accordance with yet another exemplary embodiment of the present invention. Conditioning apparatus 700 comprises a platen 712 upon which may be removably supported a polishing substrate 714 having a polishing surface 716. Polishing substrate 714 may be any suitable polishing medium as described above with reference to polishing substrate 14 of FIG. 1. Platen 712 is coupled to a motor or other motion-inducing device that causes polishing substrate 714 to rotate about its center axis 704. Platen 712 also may be configured to move in an orbital or linear motion, or a combination of rotational, orbital and/or linear motion.

Conditioning apparatus 700 further comprises an end effector 718. A conditioning surface 724 is disposed on end effector 718. Conditioning surface 724 may be a conditioning body removably attached to end effector 718 or may be a surface integral with the end effector 718. Conditioning surface 724 may be any conditioning medium suitable for conditioning polishing substrate 714, such as the conditioning surfaces described above for conditioning surface 24 with reference to FIG. 1.

End effector 718 is supported by a first support assembly 702 having a first end 720 and a second end 722. First support assembly 702 is coupled to end effector 718 at first end 720 and may be configured to rotate end effector 718 about a central axis or may be configured to keep end effector 718 stationary during a conditioning process. First support assembly 702 is coupled at its second end 722 to a second support assembly 726. Second support assembly 726 may be any mechanism that permits the vertical movement of first support assembly 702, and hence end effector 718, and that permits the rotation of first support assembly 702 about an axis 728. Movement of first support assembly 702 about axis 728 is illustrated by arrows 730. Second support assembly 726 may have any suitable configuration, such as the configurations described above for second support assembly 526 with reference to FIGS. 5 and 6 or for support assembly 26 with reference to FIG. 1.

Second support assembly 726 is coupled to a motor 734. Motor 734 may comprise any suitable motor mechanism that permits the rotational movement of first support assembly 702 about axis 728. Motor 734 may also be configured to drive a pulley/gear assembly (not shown) that may rotate end effector 718 about its central axis. Motor 734 in turn is coupled to a servo controller/driver 736. As described in more detail below, servo controller/driver 736 is configured to measure the torque required by motor 734 to maintain a position of first support assembly 702 relative to polishing substrate 714 during a conditioning process. Servo controller/driver 736 may comprise any suitable servo controller/driver, such as those described above for servo controller/driver 36 with reference to FIG. 1.

Servo controller/driver 736 is in electrical communication with a process controller 738. Process controller 738 may be any type of microprocessor, micro-controller, or other computing device capable of executing instructions in any computing language. Process controller 738 is in electrical communication with a force regulator 740. Force regulator 740 is coupled to an air cylinder 742, which is in turn coupled to second end 722 of first support assembly 702. Force regulator 740 is configured to regulate the force with which end effector 718 contacts polishing substrate 714 by controlling air cylinder 742. While the above-described embodiment comprises a system whereby end effector 718 contacts polishing substrate 714 with a down force effected by force regulator 740, it will be appreciated that the present invention may comprise a system whereby platen 712 is in electrical communication with force regulator 740 that causes polishing substrate 714 to contact conditioning surface 724 with an upward force effected by force regulator 740. Alternatively, platen 712 and polishing substrate 714 may be disposed above end effector 718 and conditioning apparatus 700 may be configured to cause end effector 718 to contact polishing substrate 714 with an upward force or may be configured to cause platen 712 to contact end effector 718 with a down force.

During conditioning of polishing substrate 714, at a time $t_1$ second support assembly 726 and motor 734 cause conditioning surface 724 of end effector 718 to contact polishing substrate 714. In one exemplary embodiment of the invention, second support assembly 726 and motor 734 may cause conditioning surface 724 of end effector 718 to contact polishing substrate 714 anywhere substantially along a radius of polishing surface 716. In a preferred embodiment of the invention, at time $t_1$, second support assembly 726 and motor 734 cause conditioning surface 724 of end effector 718 to contact polishing substrate 714 approximately at an edge of polishing substrate 714. Before, upon, or after contact with conditioning surface 724, platen 712 and polishing surface 714 are caused to rotate about axis 704. Platen 712 and polishing substrate 714 also may be caused to move in an orbital or linear motion, or a combination of rotational, orbital and/or linear motions. Second support assembly 726 and motor 734 then cause end effector 718 to sweep across a radius of the polishing surface 716 of polishing substrate 714, that is, from the edge of polishing surface 716 to approximately the center of polishing substrate 714. End effector 718 may make one sweep across the radius of the polishing surface 716 of polishing substrate 714 or may make multiple sweeps across the radius of polishing surface 716.

As end effector 718 is moved across the radius of polishing surface 716, servo controller/driver 736 measures the torque $TQ(t_n)$ and the position of the end effector 718 at times $t_n$ during the sweep or sweeps of end effector 718, where n ranges from 1 to N, N is the total number of time increments monitored during the sweep or sweeps of end effector 718 and $t_1$ is the position of end effector 718 at the commencement of conditioning.

As described above, the shear force realized between conditioning surface 724 and polishing surface 716 may be presented as:

$$\int\int \mu(x, y, t) \times P(x, y, t)\,dx\,dy = TQ(t_n), \tag{5}$$

where $TQ(t_n)$ is a torque required by motor 734 to overcome the friction between end effector 718 and polishing surface 716 at a time $t_n$ to move end effector 718 substantially across a radius of polishing surface 716. Equation (5) may be presented in terms of average values:

$$\overline{\mu}(t_n) \times \overline{P}(t_n) = \frac{TQ(t_n)}{S(t_n)} \tag{6}$$

where $S(t_n)$ is the contact area between end effector 718 and polishing surface 716 at time $t_n$.

As the shear force is directly related to the force the end effector 718 applies to the polishing surface 716, from the calculation of $TQ(t_n)/S(t_n)$, conditioning apparatus 700 may determine the appropriate force by which end effector 718 may contact polishing surface 716 to maintain a constant shear force. Once servo controller/driver 736 has measured $TQ(t_n)$ at time $t_n$, process controller 738 may determined $S(t_n)$ and may calculate a process variable (PV) from $TQ(t_n)$ and $S(t_n)$. In one embodiment, PV may equal $TQ(t_n)/S(t_n)$. In another embodiment of the invention, PV may equal any other suitable value calculated from $TQ(t_n)$ and $S(t_n)$. Once PV is calculated by process controller 738, process controller 738, via a loop controller or any other suitable computing device, may compare PV to a Setpoint value stored within the loop controller. The Setpoint value may be obtained experimentally by process performance data and may represent the desired and/or expected value of PV at a time $t_n$ and, hence, a contact area $S(t_n)$. The Setpoint value may be dependent on the time interval $t_n$ during which $TQ(t_n)$ and $S(t_n)$ are calculated, that is, the Setpoint value may vary with time, or, alternatively, the Setpoint value may be the same value for all times $t_n$.

Process controller 738 operates as a multi-input, single-output closed loop control system (CLC) with the servo controller/driver 736 acting as a feedback element. The process controller 738 provides control output signals to the force regulator 740 so that the force of the end effector 718 against the polishing substrate 714 is modulated to uniformly maintain the shear force per unit area. As described above, the control algorithm employed by the process controller should provide at least a proportional-integral (PI) capability; however, a proportional-integral-derivative (PID) algorithm is preferred. Process controller 738 may have the same configuration as that described above for process controller 38 with reference to FIG. 1.

If the Setpoint value and PV differ by more than a predetermined allowed tolerance, process controller 738 calculates a new force by which the end effector 718 may contact polishing substrate 714 to maintain a uniform shear force throughout the conditioning process. A signal representing the value of the new force may be transmitted to force regulator 740, which in turn may modify the pressure within air cylinder 742 so that end effector 718 is urged against polishing substrate 714 with the new calculated force.

Accordingly, there has been provided methods and apparatuses for conditioning polishing surfaces utilized during CMP processing. In one embodiment, the apparatuses comprise a conditioning surface configured to engage the polishing surface with a first force while relative movement is effected between the conditioning surface and the polishing surface. A torque-measuring device is utilized to measure the torque created by the friction between the conditioning surface and the polishing surface. From this measured torque, a second force may be calculated by which the conditioning surface and polishing surface contact each other to maintain a uniform shear force during the entire conditioning process. In this regard, the uniformity of the conditioning processes both in-situ and from polishing substrate to polishing substrate may be optimized.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A method for conditioning a polishing surface that is utilized during a CMP process, the method comprising:

contacting the polishing surface and a conditioning surface with a first force, one of the polishing surface and the conditioning surface coupled to a support member having an axis;

moving at least one of the polishing surface and the conditioning surface relative to the other at a constant velocity;

measuring a torque exerted by the support arm about the axis to effect a relative position between the conditioning surface and the polishing surface;

calculating a process variable from the measured torque;

comparing the process variable to a setpoint value predetermined for the relative position of the conditioning surface and the polishing surface; and calculating a second force to be exerted between the conditioning surface and the polishing surface, if the process variable differs from the setpoint value by more than an allowed tolerance.

2. The method for conditioning a polishing surface of claim 1, further comprising the step of contacting the polishing surface and the conditioning surface with the second force.

3. The method for conditioning a polishing surface of claim 1, wherein the step of contacting the polishing surface and the conditioning surface with a first force comprises urging the conditioning surface against the polishing surface with the first force.

4. The method for conditioning a polishing surface of claim 3, wherein the step of urging the conditioning surface against the polishing surface comprises urging the conditioning surface against the polishing surface with a first down force.

5. The method for conditioning a polishing surface of claim 3, wherein the support member is coupled to the conditioning surface, and wherein the step of urging the conditioning surface against the polishing surface comprises causing the support member to urge the conditioning surface against the polishing surface.

6. The method for conditioning a polishing surface of claim 5, wherein the step of measuring a torque comprises measuring a torque exerted on the support arm to sweep the conditioning surface from a first position relative to the polishing surface to a second position relative to the polishing surface.

7. The method for conditioning a polishing surface of claim 5, wherein the step of measuring a torque comprises measuring a torque exerted on the support arm to keep the conditioning surface stationary relative to the polishing surface.

8. The method for conditioning a polishing surface of claim 1, wherein the step of moving at least one of the polishing surface and the conditioning surface comprises moving the conditioning surface across the polishing surface.

9. The method for conditioning a polishing surface of claim 1, wherein the step of moving at least one of the polishing surface and the conditioning surface comprises rotating the polishing surface about a central axis.

10. The method for conditioning a polishing surface of claim 1, wherein the step of moving at least one of the polishing surface and the conditioning surface comprises moving the conditioning surface across a radius of the polishing surface while rotating the polishing surface about a central axis.

11. The method for conditioning a polishing surface of claim 1, wherein the step of measuring a torque comprises measuring a torque utilizing a servo controller/driver.

12. The method for conditioning a polishing surface of claim 1, further comprising the step of determining the contact area between the conditioning surface and the polishing surface after the step of contacting the polishing surface and the conditioning surface.

13. The method for conditioning a polishing surface of claim 12, wherein the step of calculating a process variable from the measured torque comprises calculating the process variable from the measured torque and the contact area.

14. The method for conditioning a polishing surface of claim 1, wherein the step of comparing the process variable to a setpoint value comprises comparing the process variable to a setpoint value that is constant for all relative positions of the conditioning surface and the polishing surface.

15. The method for conditioning a polishing surface of claim 1, wherein the step of contacting the polishing surface and the conditioning surface with the second force comprises urging the conditioning surface against the polishing surface with the second force.

16. The method for conditioning a polishing surface of claim 15, wherein the step of urging the conditioning surface against the polishing surface with the second force comprises urging the conditioning surface against the polishing surface with a second down force.

17. The method for conditioning a polishing surface of claim 15, wherein the support member is coupled to the conditioning surface, and wherein the step of urging the conditioning surface against the polishing surface with the second force comprises causing the support member to urge the conditioning surface against the polishing surface with a second force.

18. The method for conditioning a polishing surface of claim 1, wherein the step of measuring the torque comprises measuring the torque at a time $t_n$, wherein n ranges from 1 to N, and N is a whole integer representing the total number of time intervals during which the torque is measured during conditioning, and wherein the method further comprises the step of terminating the conditioning of the polishing surface when the process variable does not differ from the setpoint value by more than an allowed tolerance for a predetermined number of time intervals.

19. The method for conditioning a polishing surface of claim 1, wherein the step of measuring the torque comprises measuring the torque at a time $t_n$, wherein n ranges from 1 to N, and N is a whole integer representing the total number of time intervals during which the torque is measured during conditioning, and wherein the method further comprises the step of terminating the conditioning of the polishing surface when the process variable does not differ from the setpoint value by more than an allowed tolerance for a predetermined set of time intervals.

20. The method for conditioning a polishing surface of claim 1, further comprising the steps of terminating the conditioning of the polishing surface when the second force is no less than a predetermined maximum force and replacing the conditioning surface with a replacement conditioning surface.

21. An apparatus for conditioning a polishing surface utilized during a CMP process, the apparatus comprising:

a conditioning surface configured to engage the polishing surface, wherein at least one of the conditioning surface and the polishing surface is movable relative to the other;

a support member coupled to one of the conditioning surface and the polishing surface, the support member having an axis;

a force regulator coupled to the support member and configured to cause the conditioning surface and the polishing surface to make contact with a first force;

a torque-measuring device coupled to the support member and configured to measure the torque exerted by the support member about the axis to effect a relative position between the conditioning surface and the polishing surface; and a controller coupled to the torque-measuring device and configured to calculate a process variable from the measured torque, compare the process variable to a predetermined setpoint, calculate a value of a second force if the process variable and the setpoint differ by more than an allowed tolerance, and communicate the value of the second force to the force regulator.

22. The apparatus for conditioning a polishing surface of claim 21, wherein the conditioning surface is removably attached to an end effector that is removably coupled to the support member.

23. The apparatus for conditioning a polishing surface of claim 21, wherein the conditioning surface has an elongated shape.

24. The apparatus for conditioning a polishing surface of claim 21, wherein the conditioning surface has a disk shape.

25. The apparatus for conditioning a polishing surface of claim 21, wherein the conditioning surface is configured to be moved across the polishing surface.

26. The apparatus for conditioning a polishing surface of claim 21, wherein the conditioning surface is configured to remain stationary and the polishing surface is configured to be rotated about a central axis.

27. The apparatus for conditioning a polishing surface of claim 21, wherein the conditioning surface is configured to be moved across a radius of the polishing surface.

28. The apparatus for conditioning a polishing surface of claim 21, further comprising an air cylinder, wherein the support member has a first end and a second end and is coupled to the conditioning surface at the first end and to the air cylinder at the second end, and wherein the force regulator is coupled to the air cylinder such that the force regulator, via the air cylinder and the support member, may cause the conditioning surface to contact the polishing surface with a force.

29. The apparatus for conditioning a polishing surface of claim 21, wherein the torque-measuring device is a servo controller/driver.

30. The apparatus for conditioning a polishing surface of claim 29, further comprising a motor coupled to the support member and in electrical communication with the servo controller/driver.

31. The apparatus for conditioning a polishing surface of claim 21, wherein the controller is further configured to determine the contact area between the conditioning surface and the polishing surface at a relative position of the conditioning surface and the polishing surface.

32. The apparatus for conditioning a polishing surface of claim 31, wherein the controller is configured to calculate a process variable from the measured torque and the contact area.

33. The apparatus for conditioning a polishing surface of claim 21, wherein the force regulator is in electrical communication with the controller and is configured to receive the value of the second force from the controller and to cause the conditioning surface and the polishing surface to make contact with the second force.

34. A conditioning process for conditioning a polishing surface that is utilized during a CMP process, the conditioning process comprising:

urging a conditioning surface against the polishing surface with a first force, the conditioning surface being coupled to a support member;

moving at least one of the polishing surface and the conditioning surface relative to the other at a constant velocity;

measuring a torque exerted on the support member about an axis while the support member realizes a position of the conditioning surface relative to the polishing surface at a time $t_n$, where n ranges from 1 to N, and N is a whole integer representing the total number of time intervals of a conditioning process;

using the measured torque to obtain a process variable;

comparing the process variable to a setpoint value predetermined for the position of the conditioning surface relative to the polishing surface at the time $t_n$; and calculating a second force to be exerted by the conditioning surface against the polishing surface if the process variable differs from the setpoint by more than an preset tolerance.

35. The method for conditioning a polishing surface of claim 34, wherein the step of urging a conditioning surface against the polishing surface with a first force comprises urging the conditioning surface against the polishing surface with a first down force.

36. The method for conditioning a polishing surface of claim 35, wherein the step of urging the conditioning surface against the polishing surface with a second force comprises urging the conditioning surface against the polishing surface with a second down force.

37. The method for conditioning a polishing surface of claim 34, wherein the step of moving at least one of the polishing surface and the conditioning surface comprises moving the conditioning surface across the polishing surface.

38. The method for conditioning a polishing surface of claim 34, wherein the step of moving at least one of the polishing surface and the conditioning surface comprises rotating the polishing surface about a central axis.

39. The method for conditioning a polishing surface of claim 34, wherein the step of moving at least one of the polishing surface and the conditioning surface comprises moving the conditioning surface across a radius of the polishing surface while rotating the polishing surface about a central axis.

40. The method for conditioning a polishing surface of claim 34, wherein the step of measuring a torque comprises measuring a torque exerted by the support member about the axis to sweep the conditioning surface from a first position relative to the polishing surface to a second position relative to the polishing surface.

41. The method for conditioning a polishing surface of claim 34, wherein the step of measuring a torque comprises measuring a torque exerted on the support member about the axis to keep the conditioning surface stationary while the polishing surface is rotated about a central axis.

42. The method for conditioning a polishing surface of claim 34, the method further comprising the step of determining a contact area between the conditioning surface and the polishing surface at the time $t_n$ and wherein the step of using the measured torque to obtain a process variable comprises using the measured torque and the contact area to obtain the process variable.

43. The method for conditioning a polishing surface of claim 34, wherein the step of comparing the process variable to a setpoint determined for the position of the conditioning surface relative to the polishing surface at the time $t_n$ comprises comparing the process variable to a setpoint that is constant for all times $t_1$ through $t_N$.

44. The method for conditioning a polishing surface of claim 34, wherein the step of comparing the process variable to a setpoint determined for the position of the conditioning surface relative to the polishing surface at the time $t_n$ comprises comparing the process variable to a setpoint that is dependent on the position of the conditioning surface relative to the polishing surface at the time $t_n$.

45. The method for conditioning a polishing surface of claim 34, wherein the step of measuring a torque comprises measuring a torque utilizing a servo controller/driver.

46. The method for conditioning a polishing surface of claim 34, the method further comprising the step of terminating the conditioning process when the process variable does not differ from the setpoint value by more than an allowed tolerance for a predetermined number of time intervals.

47. The method for conditioning a polishing surface of claim 34, the method further comprising the step of terminating the conditioning process when the process variable does not differ from the setpoint value by more than an allowed tolerance for a predetermined set of time intervals.

48. The method for conditioning a polishing surface of claim 34, the method further comprising the steps of terminating the conditioning process when the second force is no less than a predetermined maximum force and replacing the conditioning surface with a replacement conditioning surface.

49. The method for conditioning a polishing surface of claim 34, further comprising the step of urging the conditioning surface against the polishing surface with the second force.

* * * * *